US006890026B1

(12) United States Patent
Shin

(10) Patent No.: US 6,890,026 B1
(45) Date of Patent: May 10, 2005

(54) FOLDING CHAIR CONSTRUCTION

(75) Inventor: Justin H. Shin, Cresskill, NJ (US)

(73) Assignee: Commercial Seating Products, Inc., Little Ferry, NJ (US)

( * ) Notice: Subject to any disclaimer, the term of this patent is extended or adjusted under 35 U.S.C. 154(b) by 0 days.

(21) Appl. No.: 10/835,629

(22) Filed: Apr. 30, 2004

(51) Int. Cl.[7] ..... A47C 4/00

(52) U.S. Cl. ..... 297/16.1; 297/58; 297/239; 182/33; 182/35

(58) Field of Search ..... 297/16.1, 15, 239, 297/58, 59; 182/33, 33.3, 33.4, 35

(56) References Cited

U.S. PATENT DOCUMENTS

| | | | | | |
|---|---|---|---|---|---|
| 1,129,793 | A | | 2/1915 | Craig | |
| 1,721,294 | A | | 7/1929 | Dean | |
| 1,884,257 | A | | 10/1932 | Ronk et al. | |
| 2,350,895 | A | | 6/1944 | Hoover, Jr. | |
| 2,406,305 | A | | 8/1946 | Maurer | |
| 4,008,918 | A | * | 2/1977 | Cooper et al. | 297/16.1 |
| 4,958,885 | A | * | 9/1990 | Kassai | 297/55 |
| 5,037,116 | A | * | 8/1991 | Desanta | 297/39 |
| 5,044,690 | A | * | 9/1991 | Torrey | 297/16.1 |
| 5,096,259 | A | | 3/1992 | Stanfield | |
| 5,435,620 | A | * | 7/1995 | Cheng | 297/51 |
| 5,624,153 | A | * | 4/1997 | Censullo, Jr. | 297/59 |
| 5,738,408 | A | | 4/1998 | Wu | |
| 5,967,605 | A | | 10/1999 | Stanfield | |
| 6,092,866 | A | * | 7/2000 | Wu | 297/56 |
| 6,099,073 | A | | 8/2000 | Bruschi | |
| 6,234,571 | B1 | | 5/2001 | Atkins et al. | |
| 6,279,991 | B1 | * | 8/2001 | Atkins et al. | 297/16.1 |
| 6,305,742 | B1 | * | 10/2001 | Spendlove et al. | 297/16.1 |
| 6,386,627 | B1 | * | 5/2002 | Tsai | 297/16.1 |
| D467,089 | S | | 12/2002 | Wu | |
| 6,517,151 | B2 | * | 2/2003 | Liu | 297/16.1 |
| 6,592,182 | B1 | | 7/2003 | Noor | |
| 6,669,281 | B1 | * | 12/2003 | Huang | 297/58 |

* cited by examiner

*Primary Examiner*—Peter M. Cuomo
*Assistant Examiner*—Erika Garrett
(74) *Attorney, Agent, or Firm*—Arthur Jacob

(57) ABSTRACT

A folding chair constructed of synthetic polymeric material and having an aesthetic appearance simulating that of a traditional wooden folding chair, while incorporating structural features for facilitating uniform and stable stacking of like chairs, and for providing lighter weight, greater strength and enhanced structural integrity, increased comfort and safety and ease of operation. Lighter weight is attained through the use of hollow structural elements reinforced at critical locations for greater strength and enhanced structural integrity. Increased comfort and safety are attained by recessing certain components which otherwise could cause damage to adjacent chairs or to the clothing of persons seated upon the chair, or cause injury to the persons themselves.

20 Claims, 8 Drawing Sheets

FOLDING CHAIR CONSTRUCTION

The present invention relates generally to folding chairs and pertains, more specifically, to folding chairs constructed of synthetic polymeric materials and having structural features enabling lighter weight, greater strength, increased comfort and safety, with the ability to be stacked, when folded, in uniform, stable stacks.

Folding chairs have found widespread use in supplying temporary seating for varying numbers of attendees at functions held at many different sites. When not in use, these chairs are folded and then stacked for storage and transportation. The more desirable of these folding chairs have essentially the same appearance so that when multiple like chairs are set-up at a particular function, these multiple chairs present an aesthetically pleasing uniform arrangement of seats.

For many years, the folding chair of choice has been constructed mainly of wood, with a uniform finish. These wooden folding chairs provide a combination of comfortable seating and aesthetic appearance found to be most desirable among audiences attending a wide variety of functions. However, such wooden chairs lack long-term durability and require frequent attention in order to maintain both comfort and appearance, as well as safety through structural integrity. Moreover, these wooden chairs are more difficult to stack in effective, stable stacks.

More recently, folding chairs have been constructed of synthetic polymeric materials in an effort to overcome the shortcomings of wooden folding chairs. Generally, these plastic chairs have proven to be more durable than wooden chairs. In addition, the added flexibility in construction has enabled the incorporation of structural features which allow convenient and effective stacking. However, the cost of materials, as well as strength, weight and safety considerations, has hampered the ability to simulate, in chairs constructed of suitable synthetic polymeric materials, the desired aesthetic appearance, comfort and safety provided by the now-traditional wooden chairs.

The present invention overcomes the above-outlined shortcomings of wooden folding chairs and previously available synthetic polymeric chairs, in a chair construction readily manufactured of synthetic polymeric materials. As such, the present invention attains several objects and advantages, some of which are summarized as follows: Provides a folding chair constructed for ready manufacture of a synthetic polymeric material, while simulating closely the aesthetic appearance and seating comfort of previous folding chairs constructed of wood; provides folding chairs of synthetic polymeric materials constructed to conserve material and weight while attaining enhanced strength, comfort and safety, as well as a desired aesthetic appearance; militates against injury to a seated person or damage to a seated person's clothing; prevents damage to like chairs which otherwise could result from contact among such like chairs, either when arranged at the site of a function or when stacked for storage and transportation; enables effective stacking, when folded, in stable, compact and uniform stacks for ready storage and transportation; provides folding chairs of increased strength and durability, while more closely simulating the aesthetic appearance of traditional wooden folding chairs; facilitates the operation of a folding chair for increased ease of erection and folding; enables the economical manufacture of folding chairs requiring less maintenance over an increased service life.

The above objects and advantages are attained by the present invention which may be described briefly as a folding chair constructed for safe and comfortable seating arrangements, when erected, and for stacking with like folding chairs, when folded, the folding chair comprising: a frame member extending in longitudinal directions between a base and a longitudinally opposite top, the frame member having a pair of side rails extending longitudinally essentially parallel to one another and spaced apart laterally from one another, each side rail extending longitudinally between a basal end at the base of the frame member and a top end at the top of the frame member, a back rest extending in lateral directions between the side rails, adjacent the top ends of the side rails, a basal brace extending in lateral directions between the side rails adjacent the basal ends of the side rails, and a frame brace extending laterally between the side rails intermediate the basal end and the top end of each side rail; a support member extending in longitudinal directions between a foot and a longitudinally opposite head, the support member having a pair of side supports extending longitudinally essentially parallel to one another and spaced apart laterally from one another, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support; a first pivotal mounting arrangement mounting the support member to the frame member for pivotal movement of the support member between a folded position and an erect position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position; a seat member extending longitudinally between a front end and a rear end and laterally between opposite seat sides, the seat member having a seat surface and an opposite undersurface; a second pivotal mounting arrangement mounting the seat member to the frame member, with the seat member laterally between the side rails of the frame member, for movement between a retracted position and an extended position, the second pivotal mounting arrangement including a second pivot placed intermediate the front end and the rear end of the seat member and pivotally mounting the seat member to the side rails at a second pivotal location juxtaposed with the frame brace such that the seat member is nested within the frame member, laterally between the side rails, when in the retracted position, and the undersurface of the seat member rests upon the frame brace when in the extended position;

a coupling arrangement coupling the rear end of the seat member with the support member for securing the seat member in the extended position when the chair is erected; each side rail of the frame member including an inner surface and a laterally opposite outer surface, the inner surfaces of the side rails confronting one another, each side rail comprising a unitary construction of synthetic polymeric material having side rail walls including an inner wall and a laterally opposite outer wall, the inner wall and the outer wall being spaced apart to establish an essentially hollow cross-sectional configuration between the basal end and the top end of the side rail, and a solid side rail reinforcing section unitary with the inner wall and the outer wall and extending from the inner wall to the outer wall at the first pivot location; each side support of the support member including an inner surface and a laterally opposite outer surface, the inner surfaces of the side support confronting one another, and the outer surfaces of the side supports confronting juxtaposed corresponding inner surfaces of the side rails; and each first pivot comprising a pivot pin extending through a corresponding solid side rail reinforcing section of a corresponding side rail, the pivot pin being recessed from the outer surface of the corresponding side rail, within the solid side rail reinforcing section, so that the pivot pin does not project beyond the outer surface of the side rail, while the side rail is reinforced at the first pivot location.

In addition, the present invention provides a folding chair constructed for safe and comfortable seating arrangements, when erected, and for stacking with like folding chairs, when folded, the folding chair comprising: a frame member extending in longitudinal directions between a base and a longitudinally opposite top, the frame member having a pair of side rails extending longitudinally essentially parallel to one another and spaced apart laterally from one another, each side rail extending longitudinally between a basal end at the base of the frame member and a top end at the top of the frame member, a back rest extending in lateral directions between the side rails, adjacent the top ends of the side rails, a basal brace extending in lateral directions between the side rails adjacent the basal ends of the side rails, and a frame brace extending laterally between the side rails intermediate the basal end and the top end of each side rail; a support member extending in longitudinal directions between a foot and a longitudinally opposite head, the support member having a pair of side supports extending longitudinally essentially parallel to one another and spaced apart laterally from one another, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support; a first pivotal mounting arrangement mounting the support member to the frame member for pivotal movement of the support member between a folded position and an erect position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position; a seat member extending longitudinally between a front end and a rear end and laterally between opposite seat sides, the seat member having a seat surface and an opposite undersurface; a second pivotal mounting arrangement mounting the seat member to the frame member, with the seat member laterally between the side rails of the frame member, for movement between a retracted position and an extended position, the second pivotal mounting arrangement including a second pivot placed intermediate the front end and the rear end of the seat member and pivotally mounting the seat member to the side rails at a second pivotal location juxtaposed with the frame brace such that the seat member is nested within the frame member, laterally between the side rails, when in the retracted position, and the undersurface of the seat member rests upon the frame brace when in the extended position; a coupling arrangement coupling the rear end of the seat member with the support member for securing the seat member in the extended position when the chair is erected; each side support of the support member including a track confronting a corresponding side of the seat member, the track having a terminal end adjacent the head end of the support member; and the seat member including a follower projecting from each side of the seat member and engaged with a corresponding track for effecting simultaneous movement of the seat member between the retracted position and the extended position and of the support member between the folded position and the erect position, the terminal end of each track confronting and spaced away from a corresponding follower when the seat member is in the erect position so as to preclude engagement of the follower with the terminal end when the seat member is in the erect position.

Further, the present invention includes a folding chair constructed for safe and comfortable seating arrangements, when erected, and for stacking with like folding chairs, when folded, the folding chair comprising: a frame member extending in longitudinal directions between a base and a longitudinally opposite top, the frame member having a pair of side rails extending longitudinally essentially parallel to one another and spaced apart laterally from one another, each side rail extending longitudinally between a basal end at the base of the frame member and a top end at the top of the frame member, a back rest extending in lateral directions between the side rails, adjacent the top ends of the side rails, a basal brace extending in lateral directions between the side rails adjacent the basal ends of the side rails, and a frame brace extending laterally between the side rails intermediate the basal end and the top end of each side rail; a support member extending in longitudinal directions between a foot and a longitudinally opposite head, the support member having a pair of side supports extending longitudinally essentially parallel to one 1) another and spaced apart laterally from one another, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support; a first pivotal mounting arrangement mounting the support member to the frame member for pivotal movement of the support member between a folded position and an erect position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position; a seat member extending longitudinally between a front end and a rear end and laterally between opposite seat sides, the seat member having a seat surface and an opposite undersurface; a second pivotal mounting arrangement mounting the seat member to the frame member, with the seat member laterally between the side rails of the frame member, for movement between a retracted position and an extended position, the second pivotal mounting arrangement including a second pivot placed intermediate the front end and the rear end of the seat member and pivotally mounting the seat member to the side rails at a second pivotal location juxtaposed with the frame brace such that the seat member is nested within the frame member, laterally between the side rails, when in the retracted position, and the undersurface of the seat member rests upon the frame brace when in the extended position; a slot extending laterally along the basal brace of the frame member between laterally opposite slot ends, the slot including a shoulder at each of the opposite slot ends, closely adjacent a corresponding side rail; a stacking rib extending along the foot brace, laterally between the side supports, the stacking rib including laterally spaced apart rib ends and projecting in an orthogonal direction, relative to the longitudinal and lateral directions, to project orthogonally beyond the side supports for engaging the slot of a next adjacent like chair in a stack of like chairs when the chairs are folded to preclude relative movement between stacked like chairs in first longitudinal directions; and stacking fingers on the seat member and projecting in an orthogonal direction, relative to the longitudinal and lateral directions, to extend orthogonally from the underside of the seating member for engaging a support brace of a support member of a next adjacent like chair to preclude relative movement between the stacked like chairs in second longitudinal directions; whereby the stacked chairs establish a uniform stable stack of like chairs.

Still further, the present invention provides a folding chair constructed for safe and comfortable seating arrangements, when erected, and for stacking with like folding chairs, when folded, the folding chair comprising: a frame member extending in longitudinal directions between a base and a longitudinally opposite top, the frame member having a pair of side rails extending longitudinally essentially parallel to one another and spaced apart laterally from one another, each side rail extending longitudinally between a basal end at the base of the frame member and a top end at the top of the frame member, a back rest extending in lateral directions between the side rails, adjacent the top ends of the side rails, a basal brace extending in lateral directions between the side rails adjacent the basal ends of the side rails, and a frame brace extending laterally between the side rails intermediate the basal end and the top end of each side rail; a support member extending in longitudinal directions between a foot and a longitudinally opposite head, the support member having a pair of side supports extending longitudinally essentially parallel to one another and spaced apart laterally from one another, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support; a first pivotal mounting arrangement mounting the support member to the frame member for pivotal movement of the support member between a folded position and an erect position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position; a seat member extending longitudinally between a front end and a rear end and laterally between opposite seat sides, the seat member having a seat surface and an opposite undersurface; a second pivotal mounting arrangement mounting the seat member to the frame member, with the seat member laterally between the side rails of the frame member, for movement between a retracted position and an extended position, the second pivotal mounting arrangement including a second pivot placed intermediate the front end and the rear end of the seat member and pivotally mounting the seat member to the side rails at a second pivotal location juxtaposed with the frame brace such that the seat member is nested within the frame member, laterally between the side rails, when in the retracted position, and the undersurface of the seat member rests upon the frame brace when in the extended position; each side support including an L-shaped cross-sectional configuration providing a reinforcing flange extending longitudinally along the side support and projecting toward the frame member when the chair is erected; the seat member including a notch at an intersection between the rear end and each side of the seat member; and each reinforcing flange engaging a corresponding notch when the seat member is in the extended position and the support member is in the erect position for stabilizing the seat member against movements in longitudinal and lateral directions relative to the support member.

The present invention will be understood more fully, while still further objects and advantages will become apparent, in the following detailed description of a preferred embodiment of the invention illustrated in the accompanying drawing, in which.

Figure 1:
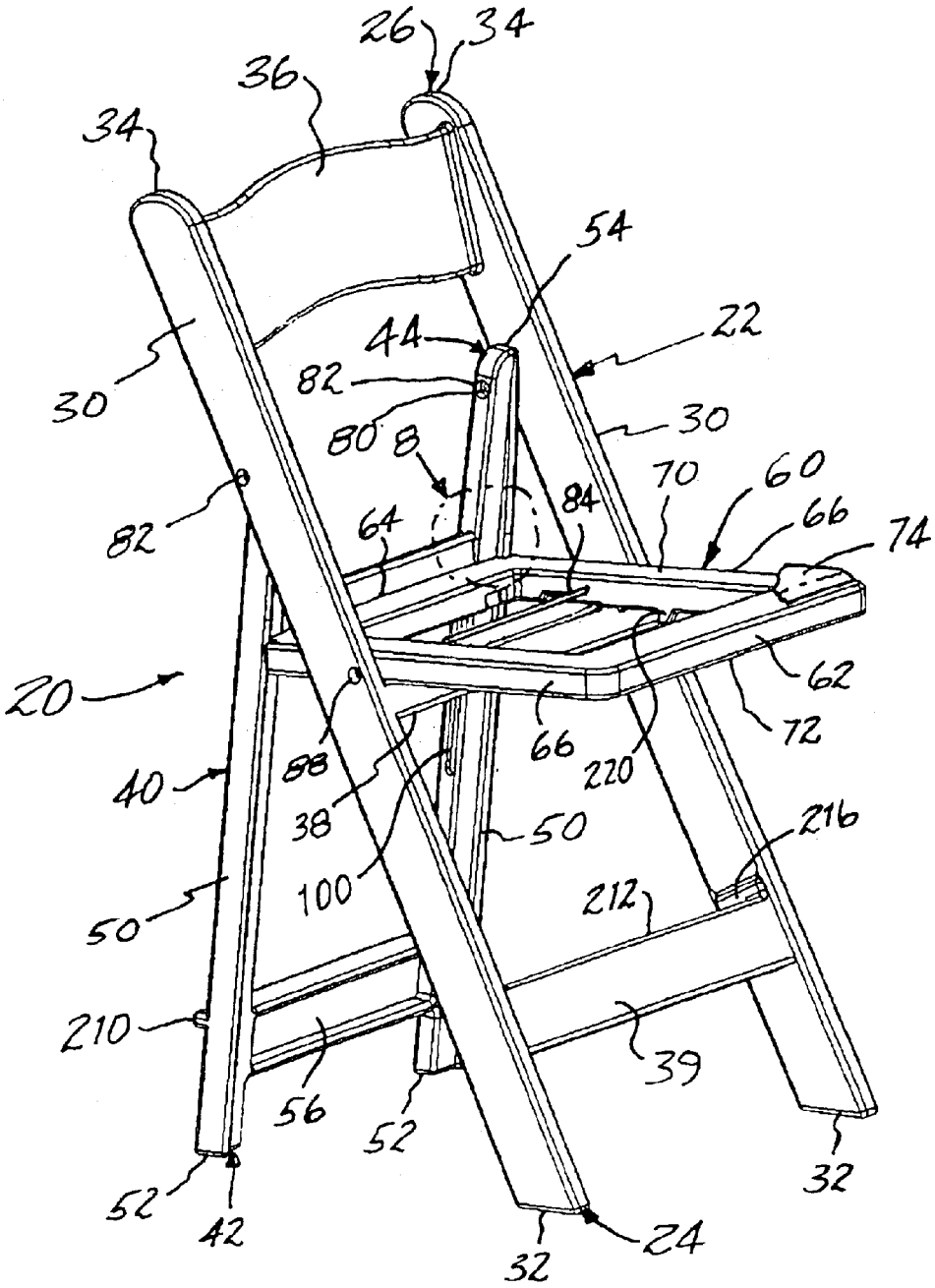
FIG. 1 is a front perspective view of a folding chair constructed in accordance with the present invention, with the chair erected.
Figure 2:
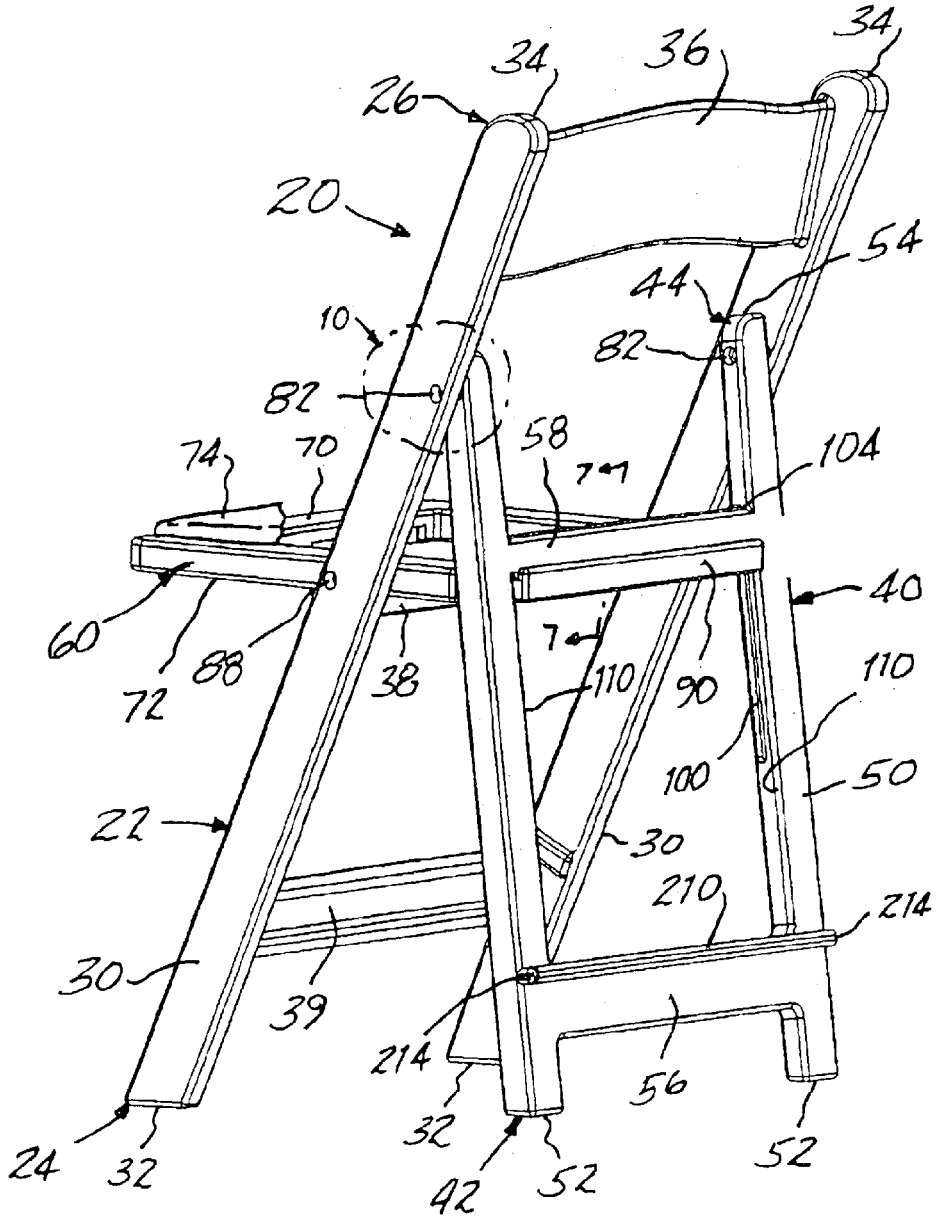
FIG. 2 is a rear perspective view of the folding chair, erected.
Figure 3:
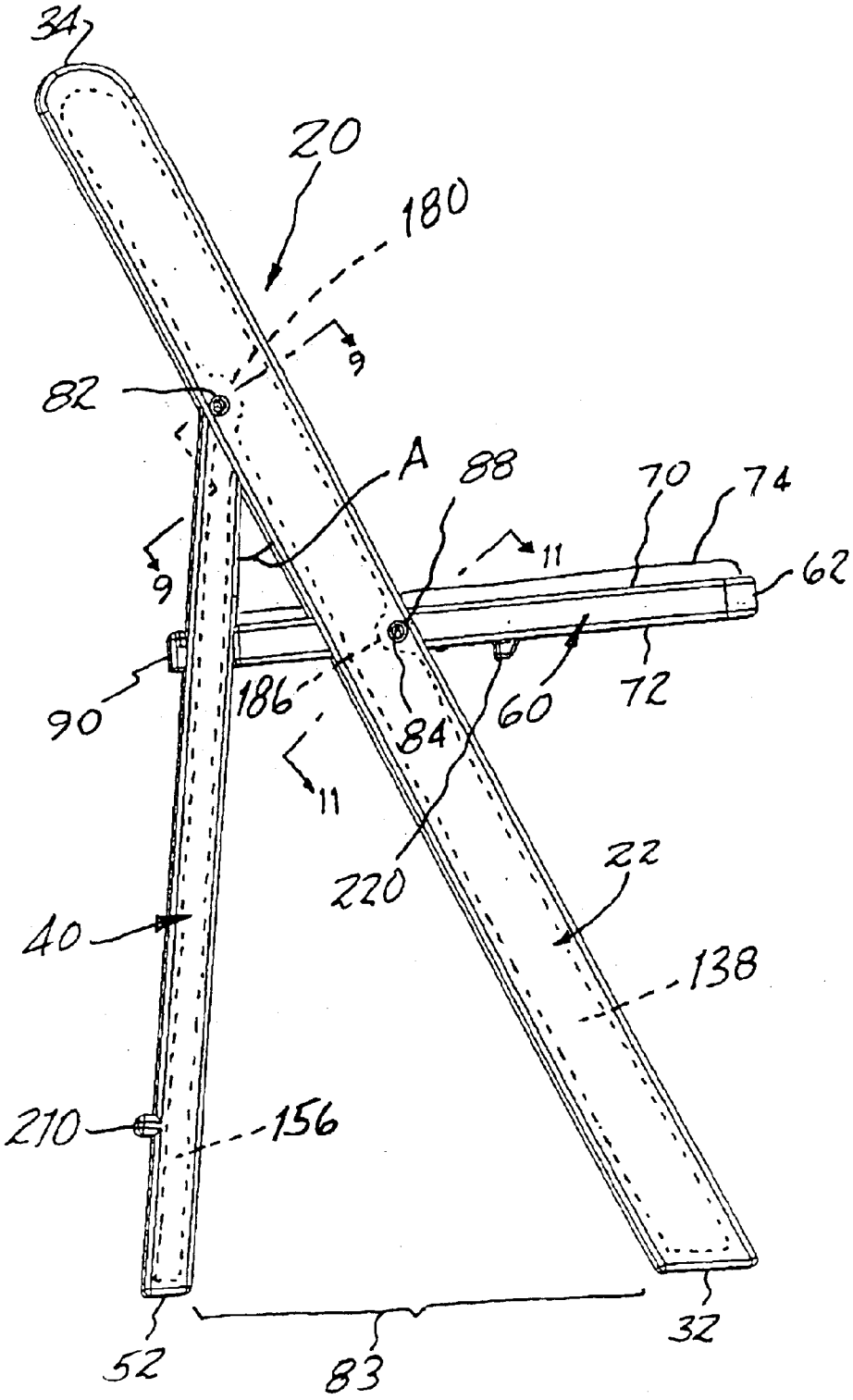
FIG. 3 is a side elevational view of the erected chair.

Referring now to the drawing, and especially to FIGS. 1 through 3 thereof, a folding chair constructed in accordance with the present invention is shown at 20 in an erected configuration and is seen to have a frame member 22 extending in longitudinal directions between a base 24 and a longitudinally opposite top 26. A pair of side rails 30 extend longitudinally essentially parallel to one another and are spaced apart laterally from one another, each side rail 30 extending longitudinally between a basal end 32 at the base 24 of frame member 22 and a top end 34 at the top 26 of the frame member 22. A back rest 36 extends in lateral directions between the side rails 30, adjacent the top ends 34 of the side rails 30, a frame brace 38 extends laterally between side rails 30 intermediate the basal end 32 and the top end 34 of each side rail 30, and a basal brace 39 extends laterally between side rails 30 adjacent the basal ends 32 of the side rails 30.

A support member 40 extends in longitudinal directions between a foot 42 and a longitudinally opposite head 44. A pair of side supports 50 extend longitudinally essentially parallel to one another and spaced apart laterally from one another, each side support 50 extending longitudinally between a foot end 52 at the foot 42 of the support member 40, and a head end 54 at the head 44 of the support member 40. A foot brace 56 extends laterally between the side supports 50, adjacent the foot end 52 of each side support 50, and a support brace 58 extends laterally between the side supports 50 intermediate the foot end 52 and the head end 54 of each side support 50.

A seat member 60 extends between a front end 62 and a rear end 64 and includes laterally opposite seat sides 66, the seat member 60 having an upper seat surface 70 and an opposite lower undersurface 72. A seat cushion 74 is affixed to the seat member 60 at the upper seat surface 70 and provides a seat upon which a person may be seated with comfort and safety when chair 20 is in the erected configuration depicted in FIGS. 1 through 3.

Figure 4:
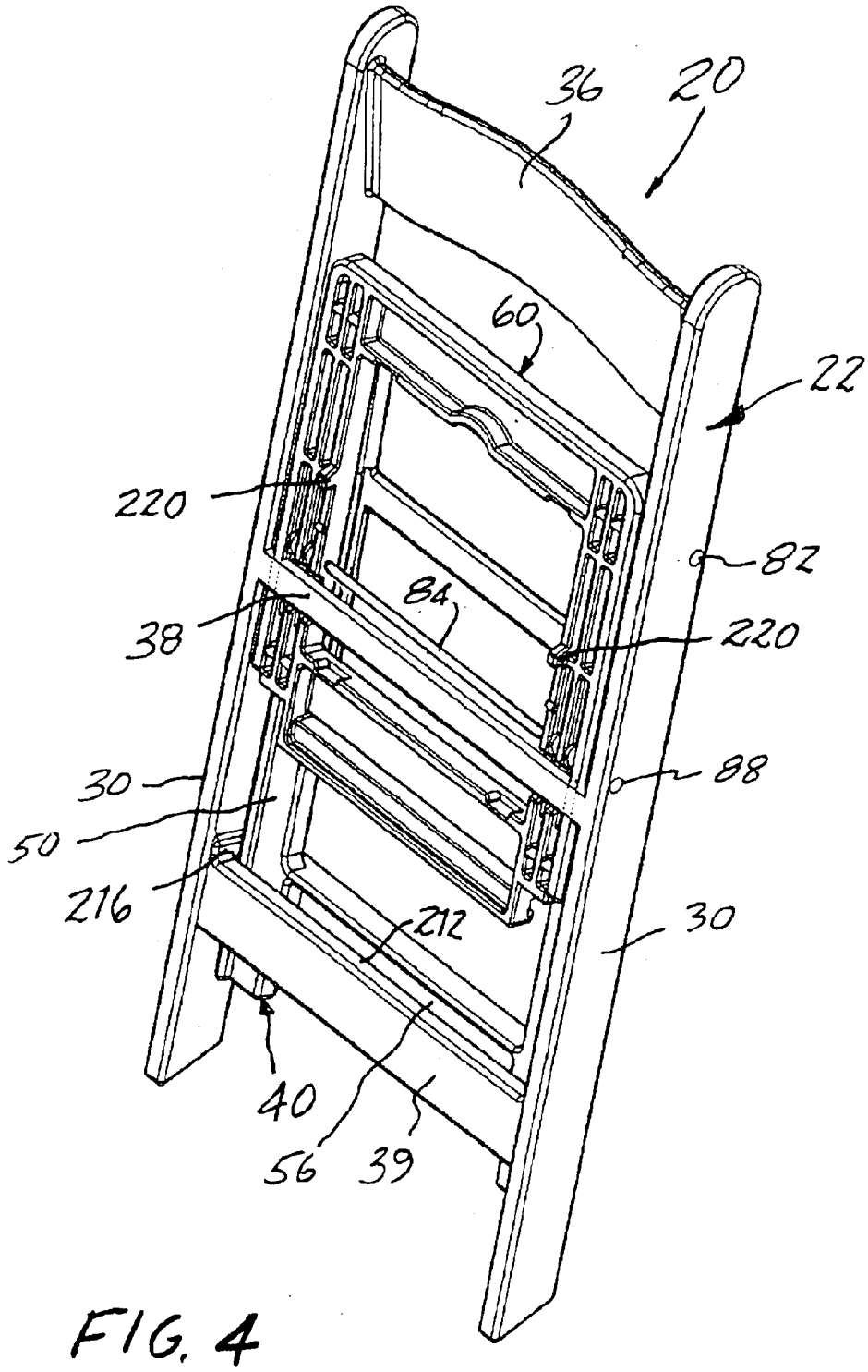
FIG. 4 is a front perspective view of the folding chair, with the chair folded.
Figure 5:
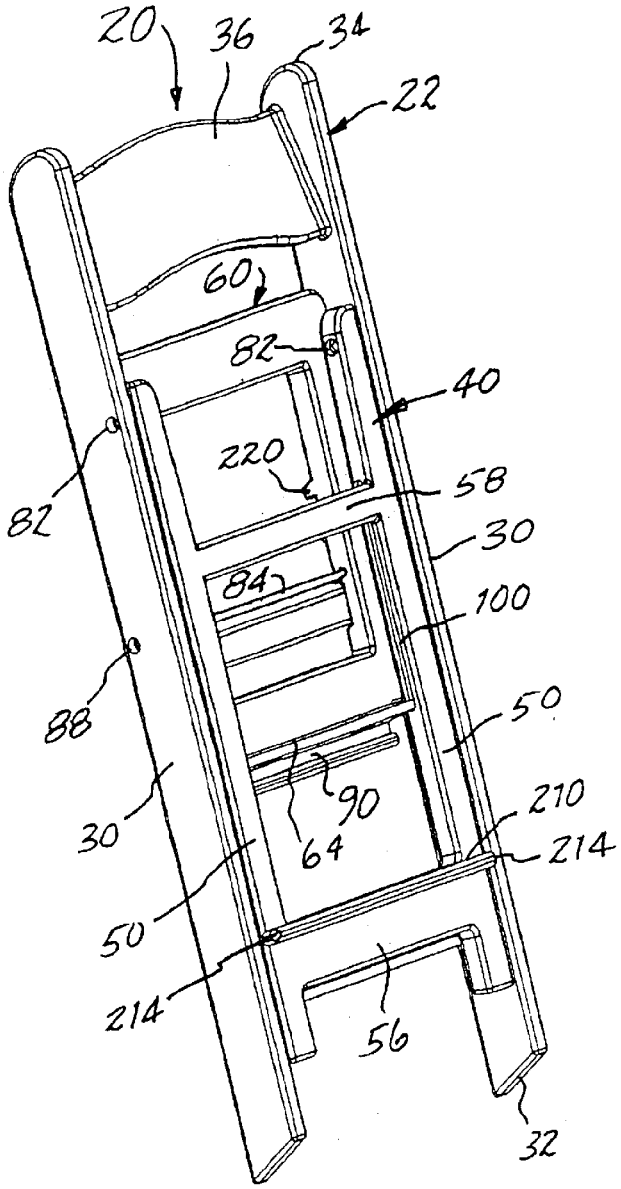
FIG. 5 is a rear perspective view of the chair, folded.
Figure 6:
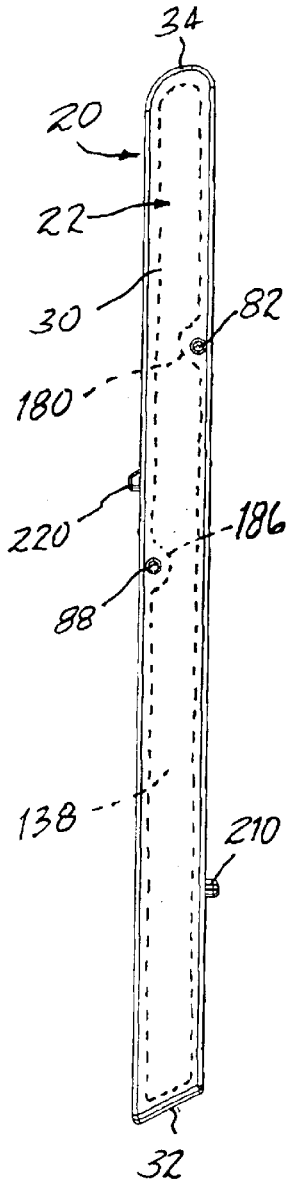
FIG. 6 is a side elevational view of the folded chair.

Chair 20 is capable of being folded from the erected configuration into a folded configuration, illustrated in FIGS. 4 through 6. To this end, a first pivotal mounting arrangement mounts the support member 40 to the frame member 22 for pivotal movement between a folded position, as seen in FIGS. 4 through 6, and an erect position, as depicted in FIGS. 1 through 3. The first pivotal mounting arrangement includes first pivots, each shown in the form of a pivot pin 80 placed at a first pivot location 82 adjacent the head end 44 of each side support 50 and pivotally mounting a respective side support 50 to a corresponding side rail 30 intermediate the back rest 36 and the frame brace 38 such that the support member 40 is nested within the frame member 22, between the side rails 30, when in the folded position, as shown in FIGS. 4 through 6, and the support member 40 makes an acute angle A with the frame member 22 to space the foot ends 52 of the side supports 50 transversely from corresponding basal ends 32 of the side rails 30, thereby establishing a chair basal support configuration at 83, when in the erect position, as depicted in FIGS. 1 through 3.

A second pivotal mounting arrangement mounts the seat member 60 to the frame member 22, with the seat member 60 laterally between the side rails 30 of the frame member 22, for movement between a retracted position, as seen in FIGS. 4 through 6, and an extended position, as depicted in FIGS. 1 through 3. The second pivotal mounting arrangement includes second pivots, shown in the form of a pivot pin 84 placed intermediate the front end 62 and the rear end 64 of the seat member 60 and which spans the seat member 60 between the sides 66 of the seat member 60 to engage the side rails 30 of frame member 22 at second pivot locations 88 juxtaposed with the frame brace 36 such that the seat member 60 is pivotally mounted to the side rails 30 at the second pivotal locations 88 for being nested within the frame member 22, laterally between the side rails 30, when in the retracted position shown in FIGS. 4 through 6, and for extending in a generally horizontal seating position, with the undersurface 72 of the seat member 60 resting upon the frame brace 38, when the seat member 60 is in the extended position, as depicted in FIGS. 1 through 3.

Figure 7:
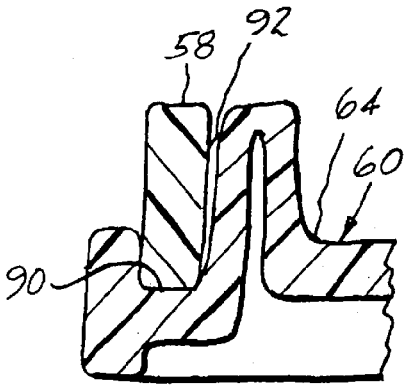
FIG. 7 is an enlarged fragmentary cross-sectional view taken along line 7—7 of FIG. 2.

A coupling arrangement couples the rear end 64 of the seat member 60 with the support member 40 for securing the seat member 60 in the extended position when the chair 20 is erected, and for maintaining the chair 20 erected, with the support member 40 and the frame member 22 at the angle A. As seen in FIG. 7, as well as in FIGS. 2 and 3, the coupling arrangement includes a channel 90 extending laterally across the seat member 60, along the rear end 64 of the seat member 60, the channel 90 having a cross-sectional configuration generally complementary to a prescribed cross-sectional configuration of the support brace 58 such that the support brace 58 is seated within the channel 90 to secure the seat member 60 in the extended position, and the chair 20 in the erected configuration. Channel 90 extends essentially all along the rear end 64 of the seat member 60 for engaging the support brace 58 along essentially the entire length of support brace 58 to maximize the support provided to seat member 60 by support brace 58, and a pair of wedges 92 are spaced along the channel 90, integral with the channel 90, to assure that the support brace 58 is fitted tightly into the channel 90 when seated so as to maintain chair 20 secured firmly in the erected configuration, thereby enhancing rigidity, for promoting comfort as well as safety.

Figure 8:
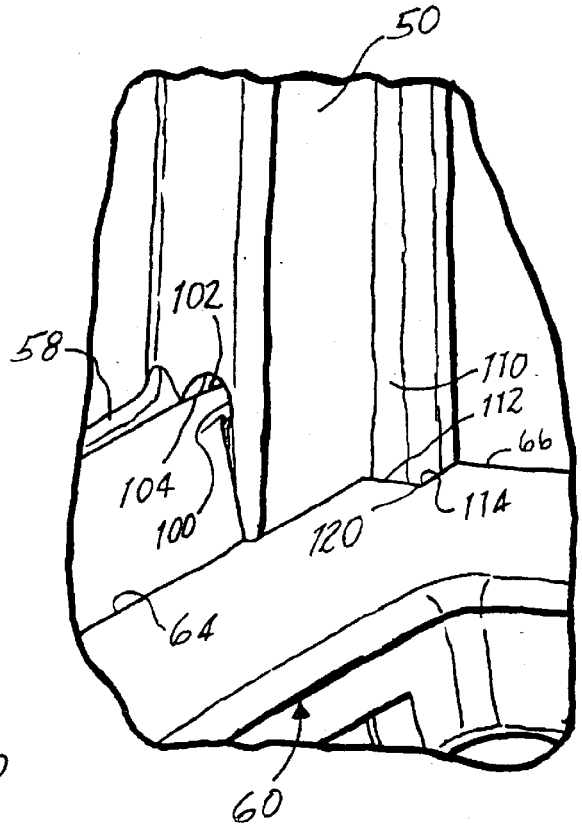
FIG. 8 is an enlarged fragmentary perspective view of a portion of the erected chair indicated at 8 in FIG. 1.

The seat member 60 is further coupled to the support member 40 such that upon movement of the seat member 60 between the retracted and extended positions, the support member 40 simultaneously is moved between the folded position, depicted in FIG. 6, and the erect position, shown in FIG. 3. Thus, each side support 50 includes a track 100 extending longitudinally along a side support 50, with the tracks 100 confronting one another, and, as best seen in FIG. 8, the seat member 60 carries a follower 102 projecting from each side 66 of the seat member 60 and engaged with a corresponding track 100. As illustrated in FIG. 8, as well as in FIG. 2, each track 100 has a terminal end 104 adjacent the head end 54 of corresponding side support 50, and the terminal end 104 is spaced away from the follower 102 engaged with the track 100 such that upon erection of chair 20 and seating of a person on the fully extended seat member 60, movement of the seat member 60 beyond the extended position is precluded by the engagement between the channel 90 and the support brace 58, and engagement between the follower 102 and the terminal end 104 of the track 100 is precluded, thereby assuring that stresses induced by the seating of a person on the seat member 60 are not transmitted to the followers 102 and the followers 102 are protected against being damaged and even sheared from the seat member 60 by such stresses.

As seen further in FIG. 8, as well as in FIGS. 1 through 3, each side support 50 of the support member 40 includes an L-shaped cross-sectional configuration providing a reinforcing flange 110 along the length of the side support 50 for added support strength. Seat member 60 includes a notch 112 located at each intersection 114 between the rear end 64 and the sides 66 of the seat member 60, and each notch 112 is complementary to a corresponding flange 110 at 120. When chair 20 is placed in the erected configuration, each flange 110 is seated within a corresponding notch 112 to lend rigidity to chair 20, especially in lateral directions, when erected.

Figure 9:
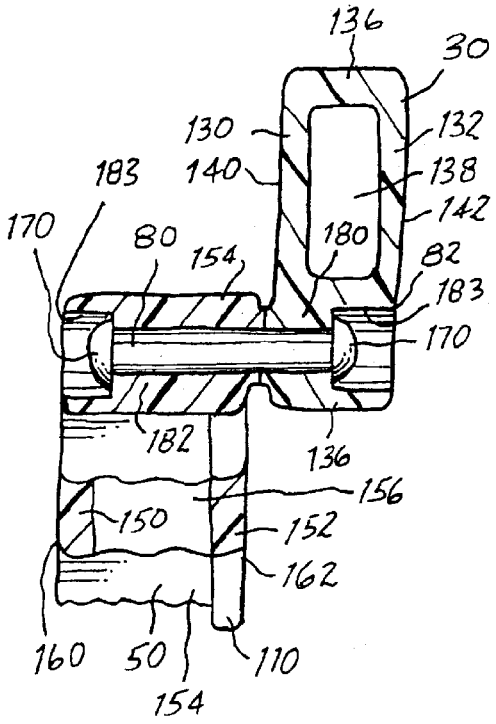
FIG. 9 is an enlarged, fragmentary cross-sectional view taken along line 9—9 of FIG. 3.
Figure 10:
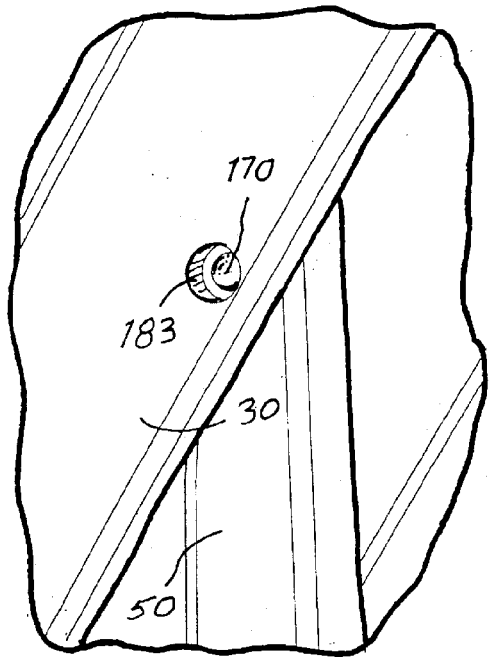
FIG. 10 is an enlarged fragmentary perspective view of a portion of the chair indicated at 10 in FIG. 2.
Figure 11:
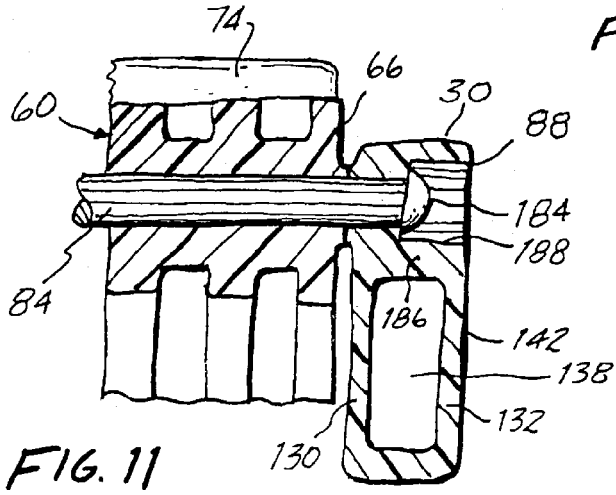
FIG. 11 is an enlarged, fragmentary cross-sectional view taken along line 11—11 of FIG. 3.

In the preferred construction of chair 20, each of the frame member 22, the support member 40 and the seat member 60, is molded of a synthetic polymeric material, such as polypropylene, each being unitary for strength as well as for economy of manufacture. In order to conserve material and reduce weight, while still maintaining sufficient structural strength and the desired aesthetic appearance which simulates the appearance of a traditional wooden folding chair, at least the frame member 22 and the support member 40 include hollow structural elements. Turning now to FIGS. 9 through 11, as well as to FIGS. 1, 3 and 6, the side rails 30 of frame member 22 each include an inner wall 130 and an outer wall 132 spaced apart laterally from one another and edge walls 136 spaced apart transversely from one another such that a cavity 138 extends through each side rail 30, establishing a hollow cross-sectional configuration in each side rail 30 extending essentially from the basal end 32 to the top end 34 of the side rail 30. Each side rail 30 includes an inner surface 140 extending along the inner wall 130, and an outer surface 142 extending along the outer wall 132, with the inner surfaces 140 of the side rails 30 confronting one another.

Likewise, the side supports 50 of support member 40 each include an inner wall 150 and an outer wall 152 spaced apart laterally from one another, and edge walls 154 spaced apart transversely from one another such that a cavity 156 extends through each side support 50, establishing a hollow cross-sectional configuration in each side support 50 extending essentially from the foot end 52 to the head end 54 of the side support 50. Each side support 50 includes an inner surface 160 extending along the inner wall 150, and an outer surface 162 extending along the outer wall 152, with the inner surfaces 160 of the side supports 50 confronting one another.

For increased strength and safety, the pivot pins 80 and 84 are constructed of a high-strength material, such as steel, and extend through the side rails 30, with pivot pins 80 extending through the side supports 50, and pivot pin 84 extending through the seat member 60, as described above. Pivot pins 80 are held in place by a head 170 at each end of the pivot pin 80. In order to avoid damage to the clothing of a person seated in an erect chair 20, or brushing against an erect chair 20 during a function, and to prevent injury to the person himself, the heads 170 are recessed relative to the outer surface 142 of each side rail 30 and the inner surface 160 of each side support 50 so as not to protrude beyond either the outer surface 142 or the inner surface 160, thereby precluding any snagging of clothing or any abrasion of a person which might otherwise result from a pivot pin that protrudes beyond either outer surface 142 or inner surface 160. Appropriate recessing of heads 170 is accomplished while maintaining strength and enhanced structural integrity at the first pivot locations 82 by providing a solid side rail reinforcing section 180 unitary with the inner wall 130 and the outer wall 132 of each side rail 30, and extending from the inner wall 130 to the outer wall 132, and by providing a solid side support reinforcing section 182 unitary with the inner wall 150 and the outer wall 152 of each side support 50, and extending from the inner wall 150 to the outer wall 152, at the first pivot location 82, with each head 170 within a recess 183 in a corresponding solid reinforcing section 180 or 182, as seen in FIGS. 9 and 10.

In a similar manner, pivot pin 84 is recessed at the second pivot locations 88. As seen in FIGS. 1, 2 and 11, each head 184 of pivot pin 84 is recessed from the outer surface 142 of a respective side rail 30 within a further solid side rail reinforcing section 186 unitary with the inner wall 130 and the outer wall 132 of each side rail 30, and extending from the inner wall 130 to the outer wall 132, at the second pivot location 88, with each head 184 placed within a recess 188 in a corresponding solid reinforcing section 186, as seen in FIG. 11. It is noted that the recessing of pivot pins 80 and 84 also serves to militate against damage to adjacent like chairs 20, as by scratching or gouging, when multiple chairs 20 are set up in rows of adjacent chairs.

Figure 12:
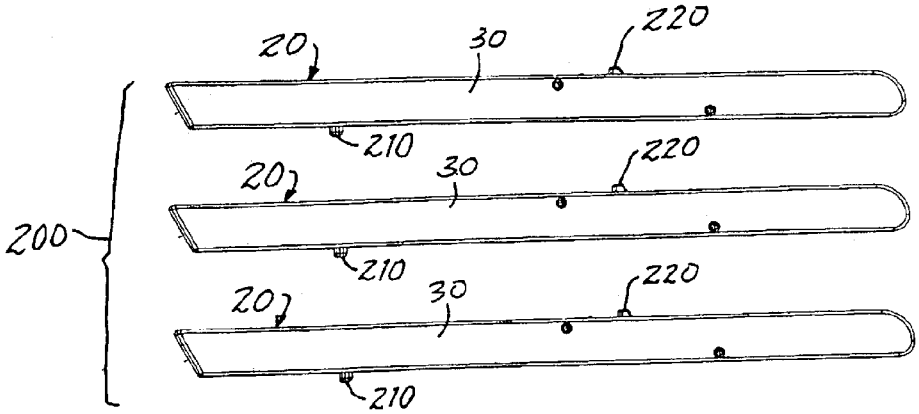
FIG. 12 is an exploded elevational view of like chairs being placed in a stack.
Figure 13:
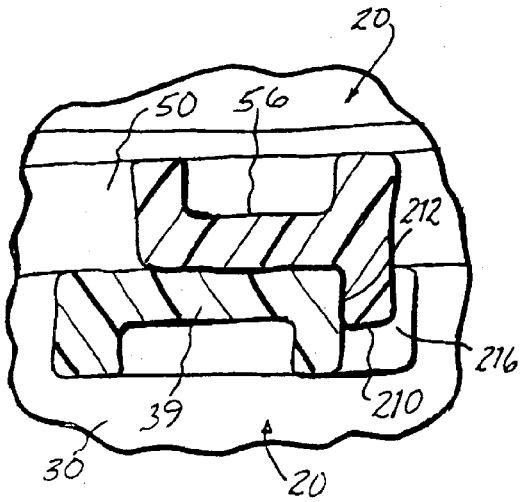
FIG. 13 is an enlarged fragmentary view, partially sectioned, of a portion of the stack of chairs.
Figure 14:
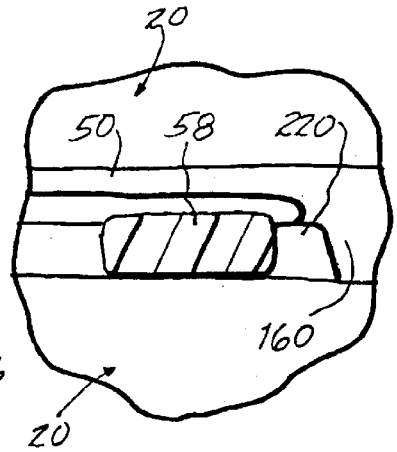
FIG. 14 is an enlarged fragmentary view, partially sectioned, of another portion of the stack of chairs.

Turning now to FIGS. 12 through 14, as well as to FIGS. 1 through 6, chair 20 is constructed for ready stacking with like chairs 20, when in the folded configuration. A typical stack 200 is shown being formed in FIG. 12 wherein several like chairs 20 are folded and are arranged one above another. In order to facilitate the completion of a uniform stack 200 and to stabilize the completed stack 200, a stacking rib 210 is provided and extends along foot brace 56 of support member 40. Rib 210 preferably is molded integral with the foot brace 56 and projects from the foot brace 56 in an orthogonal direction, relative to the longitudinal and lateral directions set forth above, to extend beyond the side supports 50, and orthogonally beyond the side rails 30, for juxtaposition with basal brace 39 of the next adjacent chair 20 in the stack 200, as seen in FIG. 13. Basal brace 39 is provided with a laterally extending slot 212 within which the stacking rib 210 of the next adjacent chair 20 is seated to preclude relative movement between the adjacent chairs 20 in first longitudinal directions toward one another by virtue of the engagement of the rib 210 of one chair 20 and the slot 212 within basal brace 39 of the next adjacent chair 20. At the same time, opposite rib ends 214 of the rib 210 are juxtaposed with corresponding opposed shoulders 216 placed at the ends of the slot 212 within the basal brace 39 of the next adjacent chair 20, and relative movement between one chair 20 and the next adjacent chair 20 in lateral directions is precluded by the engagement of the rib ends 214 with corresponding shoulders 214 at the ends of the slot 210.

Relative longitudinal movement between adjacent chairs 20 in stack 200 in second longitudinal directions, opposite to the above first longitudinal directions, is precluded by stacking fingers 220 molded integral with the seat member 60 and projecting from the undersurface 72 of the seat member 60 in an orthogonal direction, relative to the longitudinal and lateral directions set forth above, to extend beyond the side supports 50 of the next adjacent chair 20 for engagement with the support brace 58 of the next adjacent chair 20, as seen in FIG. 14, to preclude relative movement in the second longitudinal directions toward one another. At the same time, the stacking fingers 220 are spaced apart laterally for juxtaposition with corresponding inner surfaces 160 of the side supports 50 of the support member 40 of the next adjacent chair 20 to preclude relative movement between one chair 20 and the next adjacent chair 20 in stack 200 in lateral directions, by the engagement of the stacking fingers 200 with the corresponding inner surfaces 160 of the side supports 50. In this manner, a uniform, compact stack 200 is formed easily and is conveniently and effectively stabilized for facilitating storage and transportation of chairs 20 in the folded configuration.

It will be seen that the present invention attains all of the objects and advantages summarized above, namely: Provides a folding chair constructed for ready manufacture of a synthetic polymeric material, while simulating closely the aesthetic appearance and seating comfort of previous folding chairs constructed of wood; provides folding chairs of synthetic polymeric materials constructed to conserve material and weight while attaining enhanced strength, comfort and safety, as well as a desired aesthetic appearance; militates against injury to a seated person or damage to a seated person's clothing; prevents damage to like chairs which otherwise could result from contact among such like chairs, either when arranged at the site of a function or when stacked for storage and transportation; enables effective stacking, when folded, in stable, compact and uniform stacks for ready storage and transportation; provides folding chairs of increased strength and durability, while more closely simulating the aesthetic appearance of traditional wooden folding chairs; facilitates the operation of a folding chair for increased ease of erection and folding; enables the economical manufacture of folding chairs requiring less maintenance over an increased service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A folding chair constructed for safe and comfortable seating arrangements, when erected, and for stacking with like folding chairs, when folded, the folding chair comprising:

a frame member extending in longitudinal directions between a base and a longitudinally opposite top, the frame member having a pair of side rails extending longitudinally essentially parallel to one another and spaced apart laterally from one another, each side rail extending longitudinally between a basal end at the base of the frame member and a top end at the top of the frame member, a back rest extending in lateral directions between the side rails, adjacent the top ends of the side rails, a basal brace extending in lateral directions between the side rails adjacent the basal ends of the side rails, and a frame brace extending laterally between the side rails intermediate the basal end and the top end of each side rail;

a support member extending in longitudinal directions between a foot and a longitudinally opposite head, the support member having a pair of side supports extending longitudinally essentially parallel to one another and spaced apart laterally from one another, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support;

a first pivotal mounting arrangement mounting the support member to the frame member for pivotal movement of the support member between a folded position and an erect position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position;

a seat member extending longitudinally between a front end and a rear end and laterally between opposite seat sides, the seat member having a seat surface and an opposite undersurface;

a second pivotal mounting arrangement mounting the seat member to the frame member, with the seat member laterally between the side rails of the frame member, for movement between a retracted position and an extended position, the second pivotal mounting arrangement including a second pivot placed intermediate the front end and the rear end of the seat member and pivotally mounting the seat member to the side rails at a second pivotal location juxtaposed with the frame brace such that the seat member is nested within the frame member, laterally between the side rails, when in the retracted position, and the undersurface of the seat member rests upon the frame brace when in the extended position;

a coupling arrangement coupling the rear end of the seat member with the support member for securing the seat member in the extended position when the chair is erected;

each side rail of the frame member including an inner surface and a laterally opposite outer surface, the inner surfaces of the side rails confronting one another, each side rail comprising a unitary construction of synthetic polymeric material having side rail walls including an inner wall and a laterally opposite outer wall, the inner wall and the outer wall being spaced apart to establish an essentially hollow cross-sectional configuration between the basal end and the top end of the side rail, and a solid side rail reinforcing section unitary with the inner wall and the outer wall and extending from the inner wall to the outer wall at the first pivot location;

each side support of the support member including an inner surface and a laterally opposite outer surface, the inner surfaces of the side support confronting one another, and the outer surfaces of the side supports confronting juxtaposed corresponding inner surfaces of the side rails; and each first pivot comprising a pivot pin extending through a corresponding solid side rail reinforcing section of a corresponding side rail, the pivot pin being recessed from the outer surface of the corresponding side rail, within the solid side rail reinforcing section, so that the pivot pin does not project beyond the outer surface of the side rail, while the side rail is reinforced at the first pivot location.

2. The folding chair of claim 1 wherein the frame member, the support member, and the seat member each comprises an integral construction of synthetic polymeric material.

3. The folding chair of claim 2 wherein each of the frame member, the support member and the seat member comprises a unitary molded construction.

4. The folding chair of claim 1 wherein each side support comprises a unitary construction of synthetic polymeric material having side support walls including an inner wall and a laterally opposite outer wall, the inner wall and the outer wall being spaced apart to establish an essentially hollow cross-sectional configuration between the foot end and the head end of the side support, and a solid side support reinforcing section unitary with the inner wall and the outer wall and extending from the inner wall to the outer wall of a corresponding side support at the first pivot location, each pivot pin extending through a corresponding solid side support reinforcing section of a corresponding side support and being recessed from the inner surface of the corresponding side support, within the solid side support reinforcing section, such that the pivot pin does not project beyond the inner surface of the side support, while the side support is reinforced at the first pivot location.

5. The folding chair of claim 4 wherein the seat member includes an outer surface extending along each seat side and confronting the inner surface of a corresponding side rail, each side rail includes a further solid side rail reinforcing section unitary with the inner wall and the outer wall of the side rail and extending from the inner wall to the outer wall at the second pivot location, and the second pivot comprises at least a further pivot pin extending into the seat member and through the solid side rail reinforcing section of the corresponding side rail, the further pivot pin being recessed from the outer surface of the corresponding side rail such that the further pivot pin does not project beyond the outer surface of the corresponding side rail, while the side rail is reinforced at the second pivot location.

6. The folding chair of claim 5 wherein the further pivot pin spans the seat member between the sides of the seat member, extends through each further solid side rail reinforcing section, and is recessed from the outer surface of each side rail, within each solid side rail reinforcing section, so as not to project beyond the outer surface of either side rail, while the side rails are reinforced at each second pivot location.

7. The folding chair of claim 1 wherein the seat member includes an outer surface extending along each seat side and confronting the inner surface of a corresponding side rail, each side rail includes a further solid side rail reinforcing section unitary with the inner wall and the outer wall of the side rail and extending from the inner wall to the outer wall at the second pivot location, and the second pivot comprises at least a further pivot pin extending into the seat member and through the solid side rail reinforcing section of the corresponding side rail, the further pivot pin being recessed from the outer surface of the corresponding side rail such that the further pivot pin does not project beyond the outer surface of the corresponding side rail, while the side rail is reinforced at the second pivot location.

8. The folding chair of claim 7 wherein the further pivot pin spans the seat member between the sides of the seat member, extends through each further solid side rail reinforcing section, and is recessed from the outer surface of each side rail, within each solid side rail reinforcing section, so as not to project beyond the outer surface of either side rail, while the side rails are reinforced at each second pivot location.

9. The folding chair of claim 8 wherein the frame member, the support member, and the seat member each comprises an integral construction of synthetic polymeric material.

10. The folding chair of claim 9 wherein each of the frame member, the support member and the seat member comprises a unitary molded construction.

11. The folding chair of claim 1 wherein:

each side support of the support member includes a track confronting a corresponding side of the seat member, the track having a terminal end adjacent the head end of the support member; and the seat member includes a follower projecting from each side of the seat member and engaged with a corresponding track for effecting simultaneous movement of the seat member between the retracted position and the extended position and of the support member between the folded position and the erect position, the terminal end of each track confronting and spaced away from a corresponding follower when the seat member is in the erect position so as to preclude engagement of the follower with the terminal end when the seat member is in the erect position.

12. The folding chair of claim 1 wherein:

a slot extends laterally along the basal brace of the frame member between laterally opposite slot ends, the slot including a shoulder at each of the opposite slot ends, closely adjacent a corresponding side rail;

a stacking rib extends along the foot brace, laterally between the side supports, the stacking rib including laterally spaced apart rib ends and projecting in an orthogonal direction, relative to the longitudinal and lateral directions, to project orthogonally beyond the side supports for engaging the slot of a next adjacent like chair in a stack of like chairs when the chairs are folded to preclude relative movement between stacked like chairs in first longitudinal directions; and stacking fingers on the seat member and projecting in an orthogonal direction, relative to the longitudinal and lateral directions, to extend orthogonally from the underside of the seating member for engaging a support brace of a support member of a next adjacent like chair to preclude relative movement between the stacked like chairs in second longitudinal directions;

whereby the stacked chairs establish a uniform stable stack of like chairs.

13. The folding chair of claim 12 wherein the rib ends of the stacking rib engage corresponding shoulders of the slot engaged by the stacking rib for precluding relative movement between adjacent stacked like chairs in lateral directions.

14. The folding chair of claim 13 wherein the stacking fingers are spaced apart laterally for engaging corresponding side supports of the support member of the next adjacent like chair to preclude relative movement between the stacked like chairs in lateral directions.

15. The folding chair of claim 1 wherein:

each side support includes an L-shaped cross-sectional configuration providing a reinforcing flange extending longitudinally along the side support and projecting toward the frame member when the chair is erected;

the seat member includes a notch at an intersection between the rear end and each side of the seat member; and each reinforcing flange engages a corresponding notch when the seat member is in the extended position and the support member is in the erect position for stabilizing the seat member against movements in longitudinal and lateral directions relative to the support member.

16. A folding chair constructed for safe and comfortable seating arrangements, when erected, and for stacking with like folding chairs, when folded, the folding chair comprising:

a frame member extending in longitudinal directions between a base and a longitudinally opposite top, the frame member having a pair of side rails extending longitudinally essentially parallel to one another and spaced apart laterally from one another, each side rail extending longitudinally between a basal end at the base of the frame member and a top end at the top of the frame member, a back rest extending in lateral directions between the side rails, adjacent the top ends of the side rails, a basal brace extending in lateral directions between the side rails adjacent the basal ends of the side rails, and a frame brace extending laterally between the side rails intermediate the basal end and the top end of each side rail;

a support member extending in longitudinal directions between a foot and a longitudinally opposite head, the support member having a pair of side supports extending longitudinally essentially parallel to one another and spaced apart laterally from one another, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support;

a first pivotal mounting arrangement mounting the support member to the frame member for pivotal movement of the support member between a folded position and an erect position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position;

a seat member extending longitudinally between a front end and a rear end and laterally between opposite seat sides, the seat member having a seat surface and an opposite undersurface;

a second pivotal mounting arrangement mounting the seat member to the frame member, with the seat member laterally between the side rails of the frame member, for movement between a retracted position and an extended position, the second pivotal mounting arrangement including a second pivot placed intermediate the front end and the rear end of the seat member and pivotally mounting the seat member to the side rails at a second pivotal location juxtaposed with the frame brace such that the seat member is nested within the frame member, laterally between the side rails, when in the retracted position, and the undersurface of the seat member rests upon the frame brace when in the extended position;

a coupling arrangement coupling the rear end of the seat member with the support member for securing the seat member in the extended position when the chair is erected;

each side support of the support member including a track confronting a corresponding side of the seat member, the track having a terminal end adjacent the head end of the support member; and the seat member including a follower projecting from each side of the seat member and engaged with a corresponding track for effecting simultaneous movement of the seat member between the retracted position and the extended position and of the support member between the folded position and the erect position, the terminal end of each track confronting and spaced away from a corresponding follower when the seat member is in the erect position so as to preclude engagement of the follower with the terminal end when the seat member is in the erect position.

17. A folding chair constructed for safe and comfortable seating arrangements, when erected, and for stacking with like folding chairs, when folded, the folding chair comprising:

a frame member extending in longitudinal directions between a base and a longitudinally opposite top, the frame member having a pair of side rails extending longitudinally essentially parallel to one another and spaced apart laterally from one another, each side rail extending longitudinally between a basal end at the base of the frame member and a top end at the top of the frame member, a back rest extending in lateral directions between the side rails, adjacent the top ends of the side rails, a basal brace extending in lateral directions between the side rails adjacent the basal ends of the side rails, and a frame brace extending laterally between the side rails intermediate the basal end and the top end of each side rail;

a support member extending in longitudinal directions between a foot and a longitudinally opposite head, the support member having a pair of side supports extending longitudinally essentially parallel to one another and spaced apart laterally from one another, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support;

a first pivotal mounting arrangement mounting the support member to the frame member for pivotal movement of the support member between a folded position and an erect position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position;

a seat member extending longitudinally between a front end and a rear end and laterally between opposite seat sides, the seat member having a seat surface and an opposite undersurface;

a second pivotal mounting arrangement mounting the seat member to the frame member, with the seat member laterally between the side rails of the frame member, for movement between a retracted position and an extended position, the second pivotal mounting arrangement including a second pivot placed intermediate the front end and the rear end of the seat member and pivotally mounting the seat member to the side rails at a second pivotal location juxtaposed with the frame brace such that the seat member is nested within the frame member, laterally between the side rails, when in the retracted position, and the undersurface of the seat member rests upon the frame brace when in the extended position;

a slot extending laterally along the basal brace of the frame member between laterally opposite slot ends, the slot including a shoulder at each of the opposite slot ends, closely adjacent a corresponding side rail;

a stacking rib extending along the foot brace, laterally between the side supports, the stacking rib including laterally spaced apart rib ends and projecting in an orthogonal direction, relative to the longitudinal and lateral directions, to project orthogonally beyond the side supports for engaging the slot of a next adjacent like chair in a stack of like chairs when the chairs are folded to preclude relative movement between stacked like chairs in first longitudinal directions; and stacking fingers on the seat member and projecting in an orthogonal direction, relative to the longitudinal and lateral directions, to extend orthogonally from the underside of the seating member for engaging a support brace of a support member of a next adjacent like chair to preclude relative movement between the stacked like chairs in second longitudinal directions;

whereby the stacked chairs establish a uniform stable stack of like chairs.

18. The folding chair of claim 17 wherein the rib ends of the stacking rib engage corresponding shoulders of the slot engaged by the stacking rib for precluding relative movement between adjacent stacked like chairs in lateral directions.

19. The folding chair of claim 18 wherein the stacking fingers are spaced apart laterally for engaging corresponding side supports of the support member of the next adjacent like chair to preclude relative movement between the stacked like chairs in lateral directions.

20. A folding chair constructed for safe and comfortable seating arrangements, when erected, and for stacking with like folding chairs, when folded, the folding chair comprising:

a frame member extending in longitudinal directions between a base and a longitudinally opposite top, the frame member having a pair of side rails extending longitudinally essentially parallel to one another and spaced apart laterally from one another, each side rail extending longitudinally between a basal end at the base of the frame member and a top end at the top of the frame member, a back rest extending in lateral directions between the side rails, adjacent the top ends of the side rails, a basal brace extending in lateral directions between the side rails adjacent the basal ends of the side rails, and a frame brace extending laterally between the side rails intermediate the basal end and the top end of each side rail;

a support member extending in longitudinal directions between a foot and a longitudinally opposite head, the support member having a pair of side supports extending longitudinally essentially parallel to one another and spaced apart laterally from one another, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support;

a first pivotal mounting arrangement mounting the support member to the frame member for pivotal movement of the support member between a folded position and an erect position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position;

a seat member extending longitudinally between a front end and a rear end and laterally between opposite seat sides, the seat member having a seat surface and an opposite undersurface;

a second pivotal mounting arrangement mounting the seat member to the frame member, with the seat member laterally between the side rails of the frame member, for movement between a retracted position and an extended position, the second pivotal mounting arrangement including a second pivot placed intermediate the front end and the rear end of the seat member and pivotally mounting the seat member to the side rails at a second pivotal location juxtaposed with the frame brace such that the seat member is nested within the frame member, laterally between the side rails, when in the retracted position, and the undersurface of the seat member rests upon the frame brace when in the extended position;

each side support including an L-shaped cross-sectional configuration providing a reinforcing flange extending longitudinally along the side support and projecting toward the frame member when the chair is erected;

the seat member including a notch at an intersection between the rear end and each side of the seat member; and each reinforcing flange engaging a corresponding notch when the seat member is in the extended position and the support member is in the erect position for stabilizing the seat member against movements in longitudinal and lateral directions relative to the support member.

* * * * *